US009296216B2

(12) United States Patent
Yokouchi et al.

(10) Patent No.: US 9,296,216 B2
(45) Date of Patent: Mar. 29, 2016

(54) LIQUID EJECTING APPARATUS AND MAINTENANCE METHOD THEREOF

(71) Applicant: Seiko Epson Corporation, Tokyo (JP)

(72) Inventors: Hideya Yokouchi, Okaya (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/828,270

(22) Filed: Aug. 17, 2015

(65) Prior Publication Data

US 2015/0352857 A1 Dec. 10, 2015

Related U.S. Application Data

(60) Continuation of application No. 14/580,051, filed on Dec. 22, 2014, now Pat. No. 9,139,015, which is a continuation of application No. 14/070,933, filed on Nov. 4, 2013, now Pat. No. 9,033,466, which is a division of application No. 13/025,727, filed on Feb. 11, 2011, now Pat. No. 8,602,520.

(30) Foreign Application Priority Data

Feb. 15, 2010 (JP) ..... 2010-030432
Oct. 18, 2010 (JP) ..... 2010-233746

(51) Int. Cl.
*B41J 2/015* (2006.01)
*B41J 2/175* (2006.01)

(52) U.S. Cl.
CPC ..... *B41J 2/17566* (2013.01); *B41J 2/17596* (2013.01)

(58) Field of Classification Search
CPC ..... B41J 2/16505; B41J 2/16508; B41J 2/16585; B41J 2/16511; B41J 2/16523; B41J 2/165
See application file for complete search history.

(56) References Cited

U.S. PATENT DOCUMENTS 7,621,608 B2 11/2009 Kusunoki et al.
7,669,990 B2 3/2010 Murakami et al.
8,602,520 B2 * 12/2013 Yokouchi et al. .... B41J 2/16508 347/29
8,794,747 B2 * 8/2014 Enomoto et al. ..... B41J 2/175 347/85
2002/0113836 A1 8/2002 Sonobe
2005/0212874 A1 9/2005 Nomura et al.
2006/0132554 A1 6/2006 Ota et al.
2008/0007579 A1 1/2008 Furukawa et al.

(Continued)

FOREIGN PATENT DOCUMENTS

JP 10-129007 A 5/1998
JP 11-058786 A 3/1999

(Continued)

*Primary Examiner* — Lamson Nguyen

(57) ABSTRACT

A liquid ejecting apparatus comprising a liquid ejection head that ejects a liquid via nozzles; a first passage that communicates with the liquid ejection head, the first passage being configured to supply the liquid to the liquid ejection head; a second passage that communicates with the first passage in the liquid ejection head, the second passage forming, in cooperation with the first passage, a circulation passage; and a liquid driving unit provided in the circulation passage, the liquid driving unit being configured to move the liquid in the circulation passage when driven. The liquid is moved, by the driven liquid driving unit, at a first flow rate that maintains a meniscus of the liquid inside the nozzles after the liquid is moved at a second flow rate that is faster than the first flow rate.

9 Claims, 7 Drawing Sheets

(56) References Cited

U.S. PATENT DOCUMENTS

| | | | |
|---|---|---|---|
| 2008/0151021 | A1 | 6/2008 | Miyazawa |
| 2008/0273064 | A1 | 11/2008 | Ota et al. |
| 2009/0002467 | A1 | 1/2009 | Watanabe |
| 2009/0179972 | A1 | 7/2009 | Yamamoto |
| 2010/0085396 | A1 | 4/2010 | Yokota et al. |
| 2011/0211029 | A1 | 9/2011 | Enomoto et al. |

FOREIGN PATENT DOCUMENTS

| | | | |
|---|---|---|---|
| JP | 2004-305988 | A | 11/2004 |
| JP | 2006-159811 | A | 6/2006 |
| JP | 2007-069419 | A | 3/2007 |
| JP | 2007-331281 | A | 12/2007 |
| JP | 2008-260311 | A | 10/2008 |
| JP | 2008-273027 | A | 11/2008 |
| JP | 2009-029111 | A | 2/2009 |
| JP | 2009-143087 | A | 7/2009 |

* cited by examiner

LIQUID EJECTING APPARATUS AND MAINTENANCE METHOD THEREOF

CROSS REFERENCE TO RELATED APPLICATIONS

This application is a continuation of, and claims priority under 35 U.S.C. §120 on, U.S. application Ser. No. 14/580,051, filed Dec. 22, 2014, which is a continuation of U.S. application Ser. No. 14/070,933, filed Nov. 4, 2013, now U.S. Pat. No. 9,033,466, which is a division of U.S. application Ser. No. 13/025,727, filed Feb. 11, 2011, now U.S. Pat. No. 8,602,520, which claims priority under 35 U.S.C. §119 on Japanese patent application nos. 2010-030432 and 2010-233746, filed Feb. 15, 2010 and Oct. 18, 2010 respectively. The content of each such related application is incorporated by reference herein in its entirety.

BACKGROUND

1. Technical Field

The present invention relates to a liquid ejecting apparatus and a maintenance method of the liquid ejecting apparatus.

2. Related Art

An ink jet printer (hereinafter referred to as a "printer") capable of ejecting ink (liquid) droplets onto a printing medium from ejection orifices (nozzles) of a printing head (liquid ejection head) is known as a liquid ejecting apparatus.

Such a printer includes a tank for containing ink therein, and supplies the ink inside the tank to the printing head and ejects the ink from the printing head. The ink is generally made of a dispersion liquid containing solid content, such as pigment or the like, and a dispersion medium such as solvent.

In a case where the printer uses the ink, in particular, if the printer is powered-off and is maintained in a disused state, the solid content contained in the ink contained in the tank is separated and settled (sunken), so that the concentration of the solid content in the ink becomes uneven. If the solid content is settled and thus the concentration of the solid content becomes uneven, when the ink is ejected by again turning the power on after the power is turned off when the printing is carried out, the solid content settled in the tank is supplied to an ink jet head side as it is, such that the nozzles of the printing head are clogged or unevenness defects are produced in the printing quality.

In order to prevent such a problem, there is known a printing apparatus (printer) including two supply passages which are provided to communicate with the tank for storing (containing) the ink with the printing head, to circulate the ink between the printing head and the tank (for example, refer to JP-A-2007-331281).

However, there is a concern that the circulation of the ink may cause inflow of gas from an ejection head in the above-described configuration.

SUMMARY

An advantage of some aspects of the invention is that it provides a liquid ejecting apparatus which can suppress inflow of gas from an ejection head at a maintenance operation.

According to an aspect of the invention, there is provided a liquid ejecting apparatus comprising a liquid ejection head that ejects a liquid via nozzles; a first passage that communicates with the liquid ejection head, the first passage being configured to supply the liquid to the liquid ejection head; a second passage that communicates with the first passage in the liquid ejection head, the second passage forming, in cooperation with the first passage, a circulation passage; and a liquid driving unit provided in the circulation passage, the liquid driving unit being configured to move the liquid in the circulation passage when driven. The liquid is moved, by the driven liquid driving unit, at a first flow rate that maintains a meniscus of the liquid inside the nozzles after the liquid is moved at a second flow rate that is faster than the first flow rate.

The liquid ejecting apparatus may further include the feature that movement of the liquid at the second flow rate is capable of breaking the meniscus of the liquid inside the nozzles.

Preferably, the liquid ejecting apparatus further comprises a cap configured to cover an area that includes the nozzles of the liquid ejection head, where the liquid is moved at the second flow rate in a state in which the liquid ejection head is covered by the cap.

Preferably, the liquid ejecting apparatus further comprises a flexible member that constitutes part of an inner wall of the circulation passage, the flexible member deforming in accordance with a change of liquid pressure in the circulation passage.

The liquid ejecting apparatus preferably further comprises a valve provided in the first passage to allow and restrict flow of the liquid, which, in embodiments including the flexible member, may be in accordance with deformation of the flexible member.

The liquid ejecting apparatus may further include the feature of the valve allowing the flow of the liquid in the first passage to the liquid ejection head when pressure in the first passage between the valve and the liquid ejection head decreases and reaches a predetermined pressure higher than a first pressure at which the liquid is moved at the first flow rate.

Other objectives and attainments will become apparent from the following description taken in conjunction with drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

A liquid ejecting apparatus according to an embodiment of the invention will now be described with reference to the accompanying drawings. In this instance, in the various drawings used in the following description, the scales of the various constituents of the liquid ejecting apparatus are appropriately modified in order to allow the respective constituents to have recognizable sizes. In this embodiment, an ink jet printer is exemplified as the liquid ejecting apparatus.

Figure 1:
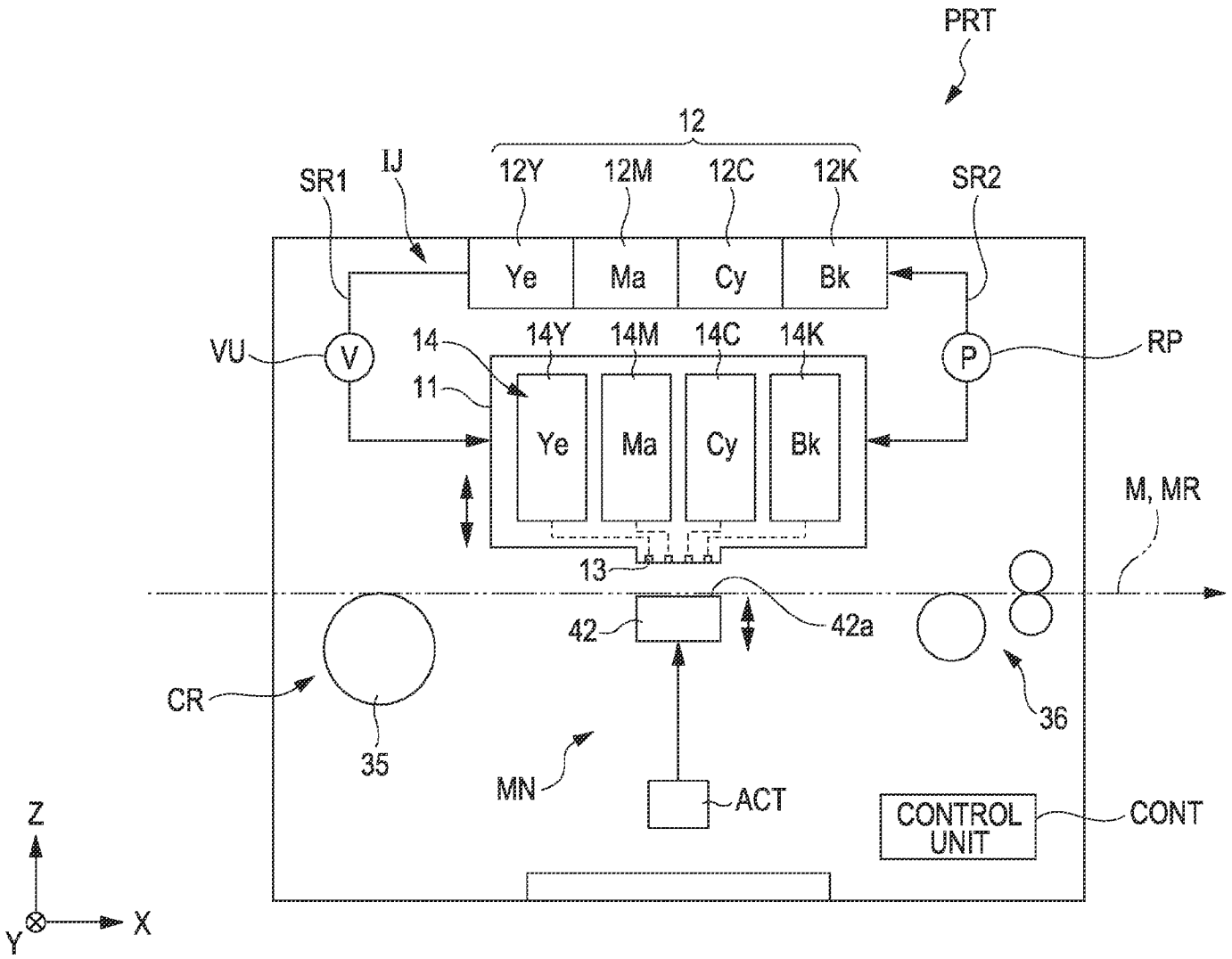
FIG. 1 is a perspective view schematically illustrating the configuration of a printer apparatus according to an embodiment of the invention.
Figure 2:
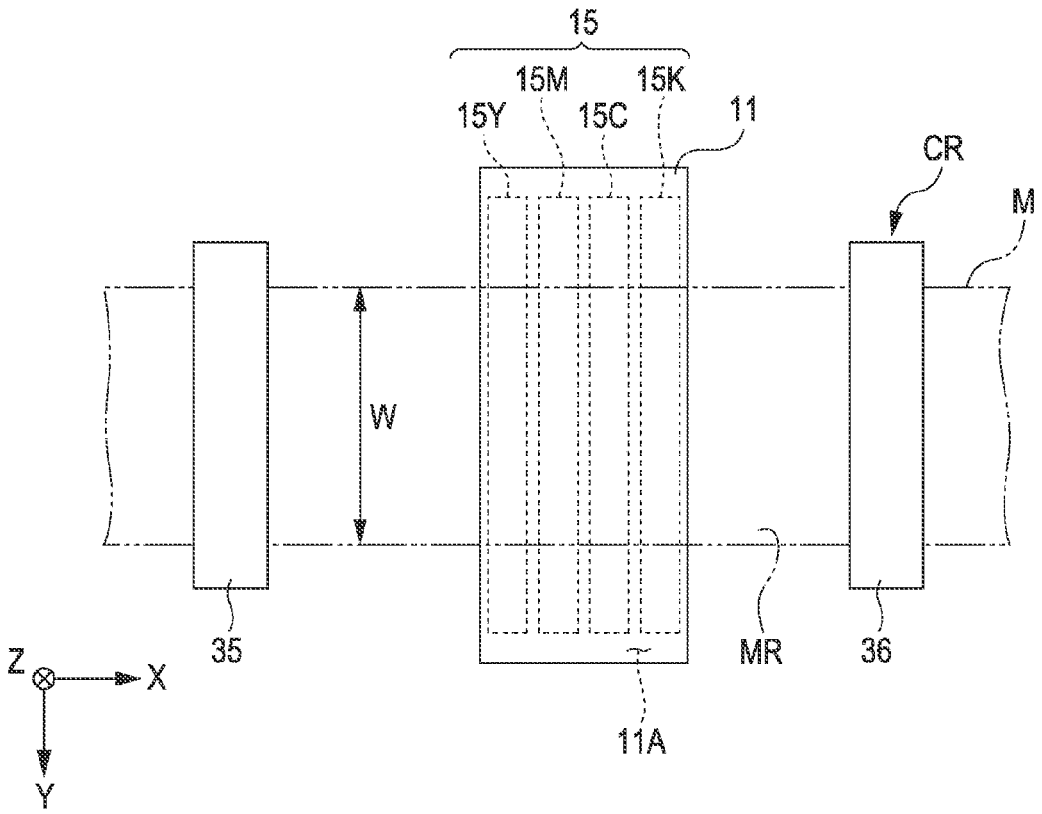
FIG. 2 is a plan view of main parts in the vicinity of an ejection head.
Figure 3:
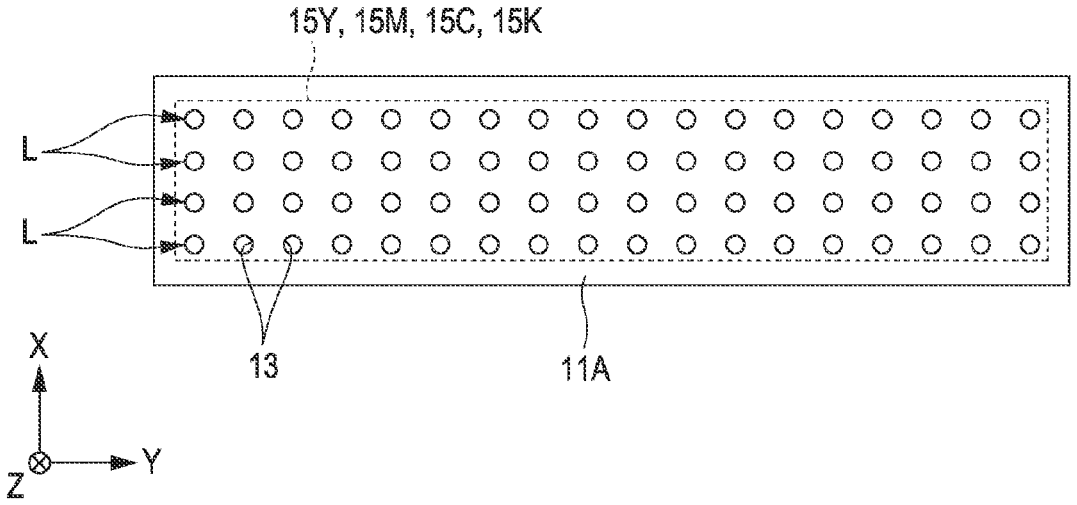
FIG. 3 is a plan view illustrating a nozzle orifice forming surface of an ejection head.

FIG. 1 is a perspective view schematically illustrating the configuration of the ink jet printer (hereinafter, simply referred to as a printer apparatus PRT) according to an embodiment of the invention. FIG. 2 is a plan view of main parts in the vicinity of an ejection head. FIG. 3 is a plan view illustrating a nozzle orifice forming surface of the ejection head.

In FIG. 1, there is a case where a Cartesian coordinate system is set, and then a positional relationship of each component is described with reference to the Cartesian coordinate system. In such a case, a transport direction of a printing medium M is set to an X direction (horizontal direction in FIG. 1), a direction perpendicular to a nozzle forming region 15 of an ejection head 11 is set to a Z direction (vertical direction in FIG. 1), and a direction perpendicular to an X-Z plane formed by an X-axis and a Y-axis is set to a Y direction (depth direction of paper in FIG. 1).

As shown in these drawings, the printer apparatus PRT is an apparatus capable of printing images, characters or the like on a printing medium M. Paper, plastic or the like can be used as the printing medium M. The printing apparatus PRT includes an ink ejection mechanism IJ, a transport mechanism CR, a maintenance mechanism MN, and a control device CONT.

The ink ejection mechanism IJ is a unit capable of ejecting ink droplets (liquid) on the printing medium M. The ink ejection mechanism IJ includes an ejection head (liquid ejection head) 11 and an ink supply unit 12. The ink used in this embodiment contains dye or pigment, and solvent for dissolving or dispersing it, as basic components, and uses a liquid material added with various additives, if necessary.

The ejection head 11 is a head capable of ejecting ink droplets of plural colors on the printing medium M. The ejection head 11 is an ejection head of a line type having a nozzle forming region 15 along the length (maximum printing sheet width W) exceeding at least one side of the printing medium M of the maximum size which is a target of the printer apparatus PRT, as shown in FIG. 2. The ejection head 11 is provided in such a manner that it is able to move in the Z direction. The ejection head 11 has nozzles 13 and common ink chambers 14 shown in FIG. 4.

The common ink chamber 14 is one chamber (common ink chambers 14Y, 14M, 14C, and 14K) for retaining each ink corresponding to, for example, four colors (yellow: Y, magenta: M, cyan: C, and black: K). The nozzle forming regions 15 is provided at a portion corresponding to the common ink chamber 14 of each color (nozzle forming regions 15Y, 15M, 15C and 15K).

The nozzles 13 are orifice portions which are discretely installed in the nozzle forming regions 15Y, 15M, 15C, and 15K respectively of the injection head 11 to discharge the ink droplets of four colors. The plurality of nozzles 13 respectively communicate with one common ink chamber 14. The nozzles 13 are discretely arranged in the Y direction (nozzle row L), as shown in FIG. 3. One row or plural rows of the nozzle row L are provided in parallel with respect to the nozzle forming regions 15Y, 15M, 15C, and 15K of each color. The number of the nozzles 13 or the number of the nozzle rows L is appropriately set. The surface of the injection head 11, in which the nozzles 13 are installed, becomes an injection surface 11A. The injection surface 11A is provided at the −Z side of the injection head 11. The injection head 11 is adapted to inject the ink droplets in the −Z side.

Figure 4:
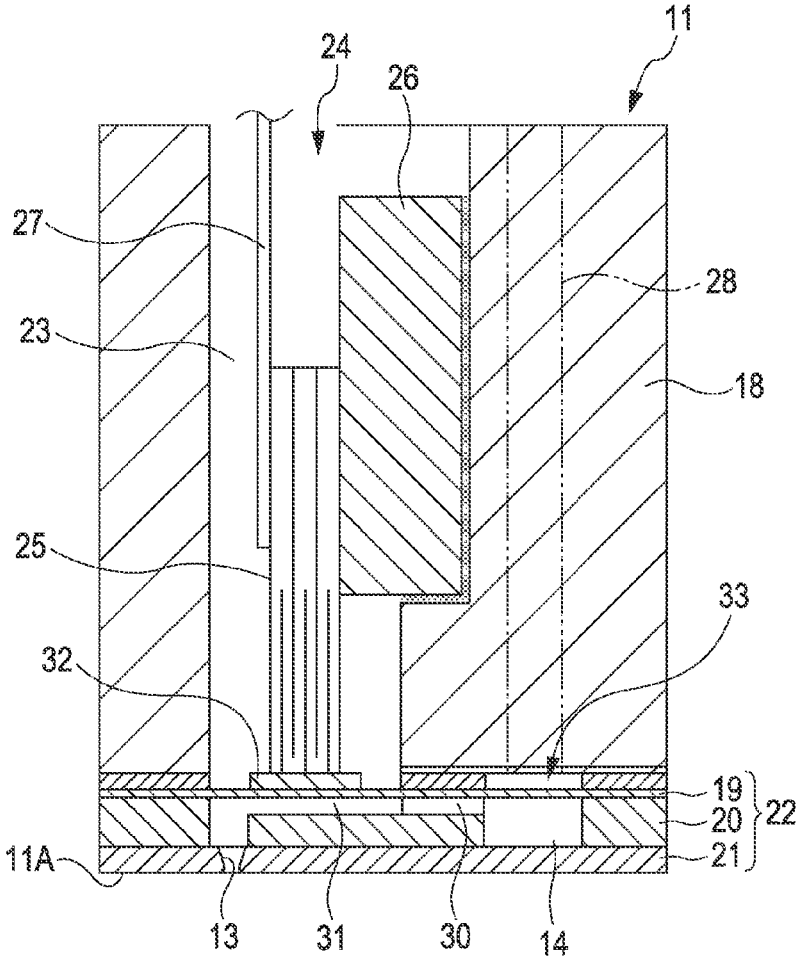
FIG. 4 is a view illustrating the cross-sectional configuration of an ejection head.

FIG. 4 is a cross-sectional view illustrating the configuration of the injection head 11.

As shown in FIG. 4, the injection head 11 includes a head body 18, and a liquid passage forming unit 22 which is connected to the head body 18. The liquid passage forming unit 22 has a vibration plate 19, a liquid passage substrate 20, and a nozzle substrate 21.

The head body 18 is provided with a plurality of piezoelectric elements 25, and each of the piezoelectric elements 25 is provided corresponding to each of the plurality of nozzles 13.

The liquid passage forming unit 22 has the common ink chambers 14, an ink supply orifice 30 connected to the corresponding common ink chamber 14, and a pressurized chamber 31 connected to the ink supply orifice 30. The pressurized chamber 31 is provided corresponding to each nozzle 13. Each of the pressurized chambers 31 is connected to the nozzle 13 at an end opposite to the common ink chamber 14.

The nozzle substrate 21 has a plurality of nozzles 13 formed at a predetermined interval (pitch) in a predetermined direction. An outer surface of the nozzle substrate 21 is an injection surface 11A.

According to the injection head 11 having the above-described configuration, when a driving signal is input to the piezoelectric element 25, the piezoelectric element 25 expands or contracts. The expansion or contraction of the piezoelectric element 25 is transmitted as deformation of the vibration plate 19. Due to the deformation of the vibration plate 19, the volume of the pressurized chamber 31 is changed, and thus the pressure of the pressurized chamber 31 receiving the ink therein is varied. The variation in pressure causes the ink to eject from the nozzles 13.

The transport mechanism CR includes a sheet transfer roller 35, a discharge roller 36, and the like. The sheet transfer roller 35 and the discharge roller 36 are adapted to be rotated by a motor mechanism (not illustrated). The transport mechanism CR transports the printing medium M along a transport path MR in connection with ejection operation of the ink droplets by the ink ejection mechanism IJ.

Returning to FIG. 1, the ink supply section (liquid storage unit) 12 is placed at one side of the ink ejection mechanism IJ, and is connected to each of the common ink chambers 14Y, 14M, 14C, and 14K of the ejection head 11. The ink supply unit 12 has ink tanks 12Y, 12M, 12C, and 12K for storing the ink of four colors.

The ink supply unit 12 is connected to the ejection head 11 via a first supply tube SR1 and a second supply tube SR2. The first supply tube SR1 is a passage (first supply passage) for supplying the ink from the ink supply unit 12 to the ejection head 11. The first supply tube SR1 is provided with a valve unit VU. The second supply tube SR2 is a passage (second supply passage) communicating with the ink supply unit 12 and the ejection head 11. The second supply tube SR2 is provided with a supply pump (liquid driving unit) RP. A flow of the ink supplied from the ink supply unit 12 to the ejection head 11 and a flow of the ink supplied from the ejection head 11 to the ink supply unit 12 are produced in accordance with a driving direction of the supply pump RP.

Figure 5:
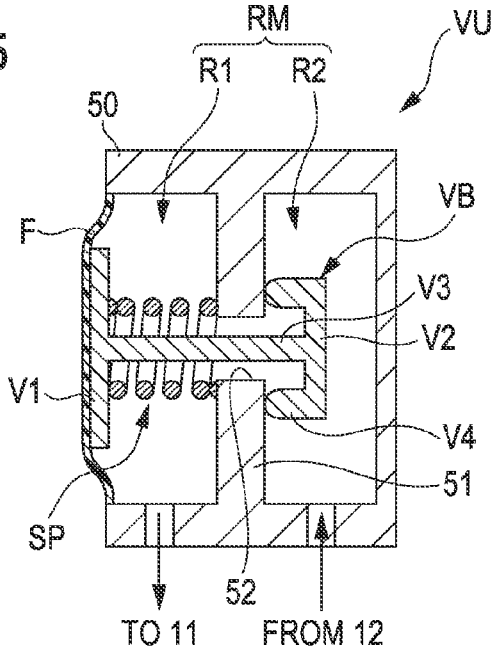
FIG. 5 is a diagram illustrating the schematic configuration of a maintenance mechanism.

FIG. 5 is a cross-sectional view schematically illustrating the configuration of the valve unit VU.

An ink receiving chamber RM is formed in a receiving chamber forming member 50. The receiving chamber forming member 50 has a partition portion 51 at a center portion of the horizontal direction in the drawing. The ink receiving chamber RM is divided into a first chamber (recessed portion) R1 and a second chamber R2 by the partition portion 51. The partition portion 51 is formed with a communication portion 52. The first chamber R1 of the ink receiving chamber RM is connected to the ink supply unit 12 via the first supply tube SR1. The second chamber R2 is connected to the ejection head 11 via the first supply tube SR1. The first chamber R1 and the second chamber R2 communicate with each other via the communication portion 52. In this way, the path from the ink supply unit 12 to the ejection head 11 is communicated in the order of the ink supply unit 12, the first supply tube SR1 (ink supply unit 12 side), the first chamber R1, the communication portion 52, the second chamber R2, the first supply tube SR1 (injection head 11 side) and the ejection head 11.

A portion (a left end in the drawing), which is different from the partition portion 51, of the wall portion enclosing the first chamber R1 of the receiving chamber forming member 50 is formed with an opening. The opening is formed so as to communicate with the exterior of the first chamber R1 and the ink receiving chamber RM. A flexible member F is attached to the opening, and the opening is constantly closed by the flexible member F.

The valve VB is formed to extend the first chamber R1 and the second chamber R2. The valve VB has a plate-shaped portion V1, a flange portion V2, and a shaft portion V3. The plate-shaped portion V1 is adhered to the flexible member F. The flange portion V2 is provided in the second chamber R2, and the flange portion V2 is provided in the second chamber R2. The flange portion V2 is formed with a sealing portion V4 for closing the communication portion 52. The communication portion 52 is interrupted by bringing the sealing portion V4 into contact with the partition portion 51.

The shaft portion V3 is placed to penetrate through the communication portion 52. The plate-shaped portion V1 and the flange portion V2 are connected to each other by the shaft portion V3. The valve VB is configured in such a way that, as the flexible member F is bent in the direction to decrease the internal volume of the ink receiving chamber RM, the sealing portion V4 is spaced apart from the partition portion 51 to open the communication portion 52.

A biasing mechanism SP is interposed between the plate-shaped portion V1 and the partition portion 51. A spring member or the like is preferably used as the biasing mechanism SP. The biasing mechanism SP bends the flexible member F in a direction of increasing an internal volume of the first chamber R1, thereby biasing the plate-shaped portion V1 toward a left side (direction spaced apart from the partition portion 51) of the drawing. The biasing force of the biasing mechanism SP is set in such a way that when the ink receiving chamber RM is lower than the predetermined pressure, the sealing portion V4 opens the communication portion 52, and for the rest, the sealing portion V4 interrupts the communication portion 52.

In the case where the ink is ejected from the ejection head 11, since the communication portion 52 is interrupted by the sealing portion V4, negative pressure is generated in the liquid passage from the first chamber R1 to the ejection head 11. If the force of bending the flexible member F due to the negative pressure is stronger than the biasing force of the biasing mechanism SP, the flexible member F is bent and thus the communication portion 52 is opened.

Since the first chamber R1 communicates with the ejection head 11 and the second chamber R2 communicates with the ink supply unit 12, the ink is supplied from the second chamber R2 to the first chamber R1 side via the communication portion 52. If the negative pressure from the first chamber R1 to the ejection head 11 by the supply of the ink is decreased, the biasing force of the biasing mechanism SP is higher than the corresponding negative pressure, the communication portion 52 is interrupted by the sealing portion V4.

In this way, since the negative pressure is generated in the passage from the first chamber R1 to the ejection head 11, the valve unit VU has an action of adjusting an ink meniscus of the nozzles, and an action of a check valve (one-way valve) through which the ink flows only in the direction from the second chamber R2 to the first chamber R1.

Returning to FIG. 1, the supply pump RP adjusts a flow direction and flow velocity (supply speed) of the ink flowing in the second supply tube SR2. According to the flow direction of the ink, the ink can be switched and supplied in either of a forward direction from the ejection head 11 to the ink supply unit 12 or a backward direction from the ink supply unit 12 to the ejection head 11. In this instance, when the flow of the ink in the second supply tube SR2 is the forward direction, the flow of the ink in the first supply tube SR1 is set to a flow direction from the ink supply unit 12 to the ejection head 11. In addition, when the flow velocity is adjusted, the supply pump RP is adapted to vary the flow velocity of at least ink supplied in the forward direction, depending upon whether or not the ejection surface 11A is covered by a cap member 42 which will be described below. In this instance, the variation in flow velocity is controlled by the control device CONT.

The maintenance mechanism MN performs a maintenance for the ejection head 11. The maintenance mechanism MN includes the cap member 42 and an actuation mechanism ACT. The cap member 42 is formed in the shape of a plate by using a material, for example, rubber, elastomer or the like. The cap member 42 has a close contact surface 42*a* which is brought into close contact with the ejection surface 11A of the ejection head 11. The close contact surface 42*a* is provided to be opposite to the ejection surface 11A of the ejection head 11. The cap member 42 is formed to have a dimension large enough to be able to cover at least a range, in which the nozzle NZ is formed, of the ejection surface 11A. For this reason, the cap member 42 is formed so as to bring it into close contact with and over the surface, in which the nozzle NZ is formed, of the ejection surface 11A, so that the surface is covered.

In this embodiment, an absorbing member (not illustrated) for receiving the ink ejected from each nozzle 13 of the ejection head 11 is provided separately from the cap member 42. The absorbing member is able to be placed on a flying path in a state where the cap member 42 is retracted from the flying path of the ink ejected from each nozzle 13. In this instance, the absorbing member placed on the flying path of the ink receives the ink from the head.

The actuation mechanism ACT moves the cap member 42 between the ejection head 11 and the actuation mechanism. An actuator such as cam mechanism, a motor mechanism, air cylinder mechanism or the like may be used as the actuation mechanism ACT. Of course, other actuator can be used.

Figure 6:
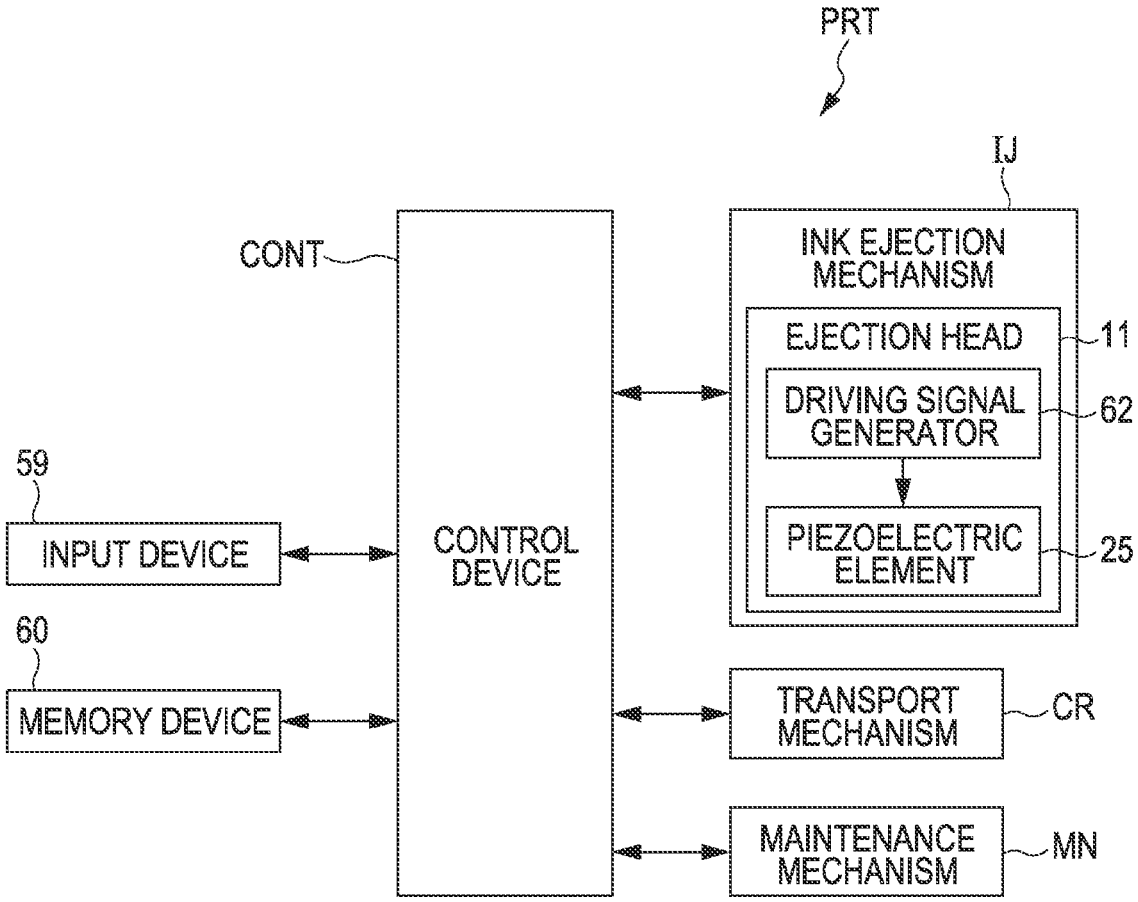
FIG. 6 is a block diagram illustrating the configuration of a printer apparatus.

FIG. 6 is a block diagram illustrating the electrical configuration of the printer apparatus PRT.

The printer apparatus PRT according to the embodiment includes the control device CONT for controlling the whole operation. The control device CONT is connected to an input device 59 for inputting various information about the operation of the printer apparatus PRT, and a memory device for storing various information about the operation of the printer apparatus PRT.

The control device CONT is connected to each section of the printer apparatus PRT, such as the ink ejection mechanism IJ, the transport mechanism CR, the maintenance mechanism MN, or the like. The printer apparatus PRT includes a driving signal generator 62 for generating a driving signal which is input to the driving unit having the piezoelectric element 25. The driving signal generator 62 is connected to the control device CONT.

The driving signal generator 62 is input with data indicative of a variation in voltage value of a discharge pulse which is input to the piezoelectric element 25 of the ejection head 11, and a timing signal defining a timing changing a voltage of the discharge pulse. The driving signal generator 62 generates a driving signal, such as discharge pulse, based on the input data and the timing signal.

Next, the operation of the printer apparatus PRT including the above-described configuration will be described.

In a case where the ejection head 11 carries out the printing operation, the control device CONT places the printing medium M on a support surface (not illustrated) by using the transport mechanism CR. After the printing medium M is placed, the control device CONT inputs the driving signal to the piezoelectric element 25 from the driving signal generator 62 based on the image data of an image to be printed.

If the driving signal is input to the piezoelectric element 25, the piezoelectric element 25 is expanded or contracted to eject the ink from the nozzles 13. The desired image is formed on the printing medium M by the ink ejected from the nozzles 13.

A capping operation is carried out as the maintenance operation of the ejection head 11. In the case of carrying out the capping operation, the control device CONT presses the cap member 42 towards the ejection head 11 side by using the driving mechanism ACT. The gap between the cap member 42 and the ejection head 11 is sealed by the operation.

If the power source of the printer apparatus PRT is turned off and thus is maintained in a disused state, a solid content contained in the ink which is received in the ink supply unit 12 is separated and settled (sunken), so that the concentration of the solid content in the ink becomes uneven. If the solid content is settled and thus the concentration of the solid content becomes uneven, when the ink is ejected to carry out the printing by again turning the power on after the power is turned off, the settled solid content is supplied to the ejection head 11 side as it is. As a result, there is problem in that the nozzles of the ejection head 11 may be clogged or unevenness may occur in the printing quality.

Accordingly, in order to prevent such a problem, the ink should be circulated between the ink supply unit 12 and the ejection head 11. The control device CONT operates the supply pump RP to cause the ink in the second supply tube SR2 to flow in the forward direction (direction from the ejection head 11 to the ink supply unit 12) or the backward direction (direction from the ink supply unit 12 to the ejection head 11).

Figure 7:
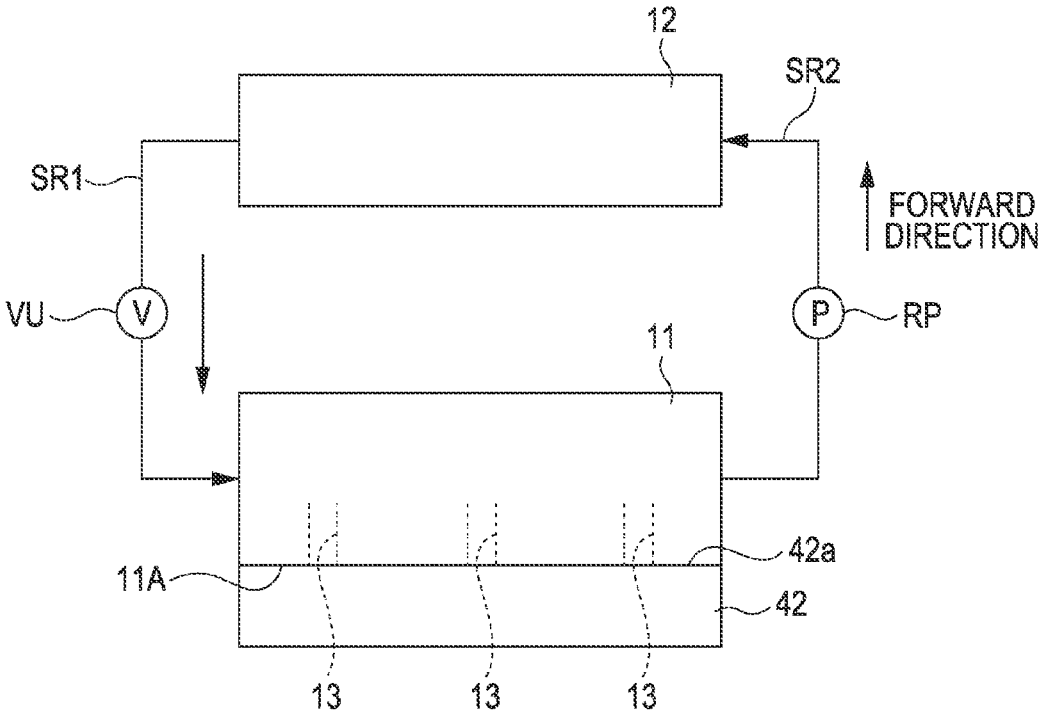
FIG. 7 is a view illustrating the operation of a printer apparatus.

As a specific example, the control device CONT operates the supply pump RP to cause the ink to flow in the forward direction in the state where the ejection surface 11A of the ejection head 11 is covered by the cap member 42, as shown in FIG. 7. The negative pressure is generated in the first chamber R1 by the operation, and thus the sealing portion V4 of the valve VB opens the communication portion 52, and the valve unit VU comes to be is in the opened state, so that the passage is communicated from the ink supply unit 12 to the ejection head 11. For this reason, the ink is supplied from the ink supply unit 12 to the ejection head 11 via the first supply tube SR1. At this time, although the negative pressure is generated in the ejection head 11 which is positioned at the upstream side of the supply pump RP, since the ejection surface 11A is covered by the cap member 42, the air does not flow in the nozzles 13, so that the ink does not leak from the nozzles 13. For this reason, it is easy to stir the settled solid content components by increasing the flow velocity (supply speed) of the ink. Since the operation is carried out in the state in which the power source of the printer device PRT is turned on, it is possible to shorten the time needed to supply the ink in a short time.

Figure 8:
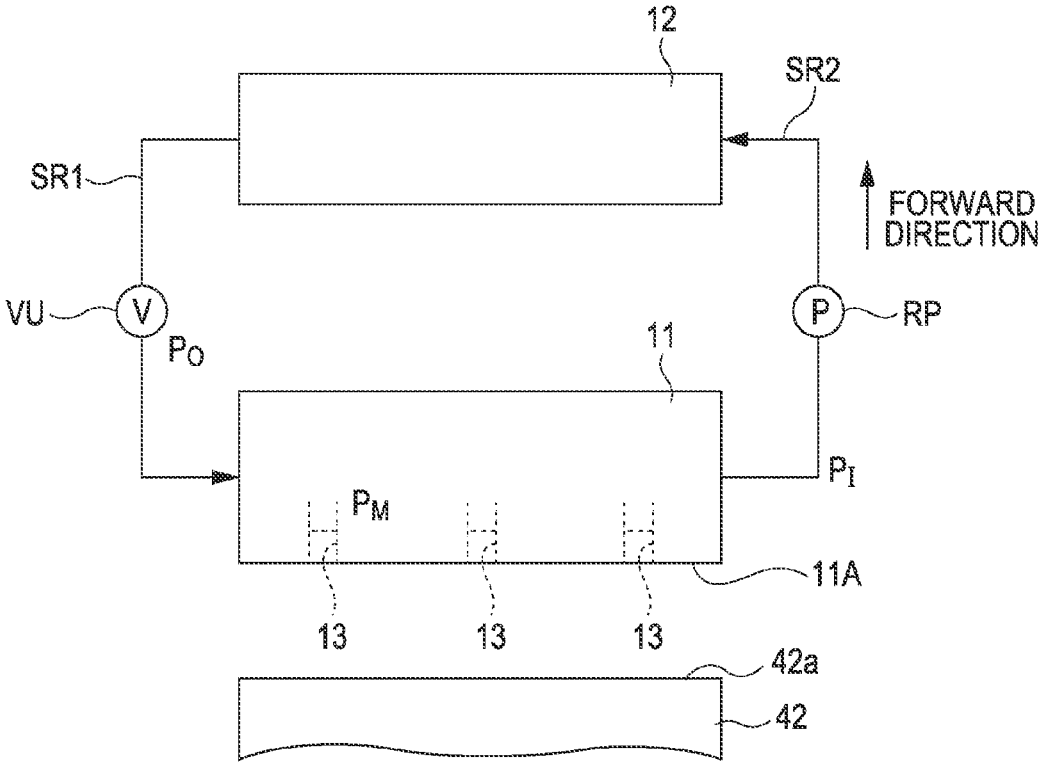
FIG. 8 is a view illustrating the operation of a printer apparatus.

In addition, as another aspect, the control device CONT may operate the supply pump RP so that the ink flows in the forward direction, as shown in FIG. 8, in the state where the ejection surface 11A of the ejection head 11 is not covered by the cap member 42. In this instance, since the ink does not flow in from the nozzles 13, the control device CONT operates the supply pump RP so that the pressure $P_I$ of the ink becomes a pressure maintaining the meniscus of the ink in the corresponding nozzle 13.

In a case where the pressure $P_O$ in the first supply tube SR1 which is required to allow the ink to pass the valve unit VU from the ink supply unit 12 is −100 Pa, and the pressure $P_M$ of maintaining the meniscus in the nozzle 13 is −200 Pa, the supply speed of the ink by the supply pump RP is adjusted in a liquid driving process so that the pressure $P_I$ of the ink is set to a value (for example, −150 Pa or the like) therebetween. In this instance, if a case where the flow pressure $P_I$ of the ink is higher than the pressure $P_O$, since the valve unit VU is in the closed state, the ink does not flow. In addition, in a case where the pressure $P_M$ of maintaining the meniscus in the nozzle 13 is less than −200 Pa, the flow pressure $P_I$ of the ink does not maintain the meniscus of the ink in the nozzle 13, such that the discharge amount of the ink cannot be accurately controlled. Accordingly, it is preferable that $P_M<P_I<P_O$. The above-mentioned values are merely one example, and the invention is not limited thereto.

The operation of supplying the ink according to the embodiment shown in FIG. 8 can be carried out for the period in which the power source of the printer apparatus PRT is turned on, and is carried out for the period different from the period in which the ink is ejected onto the printing medium M by the ejection head 11. In addition, it is preferable that after the settlement of the ink is solved by performing the operation of supplying the ink according to the embodiment shown in FIG. 7, the operation of supplying the ink according to the embodiment shown in FIG. 8 is carried out at the flow velocity not settling the ink.

Figure 9:
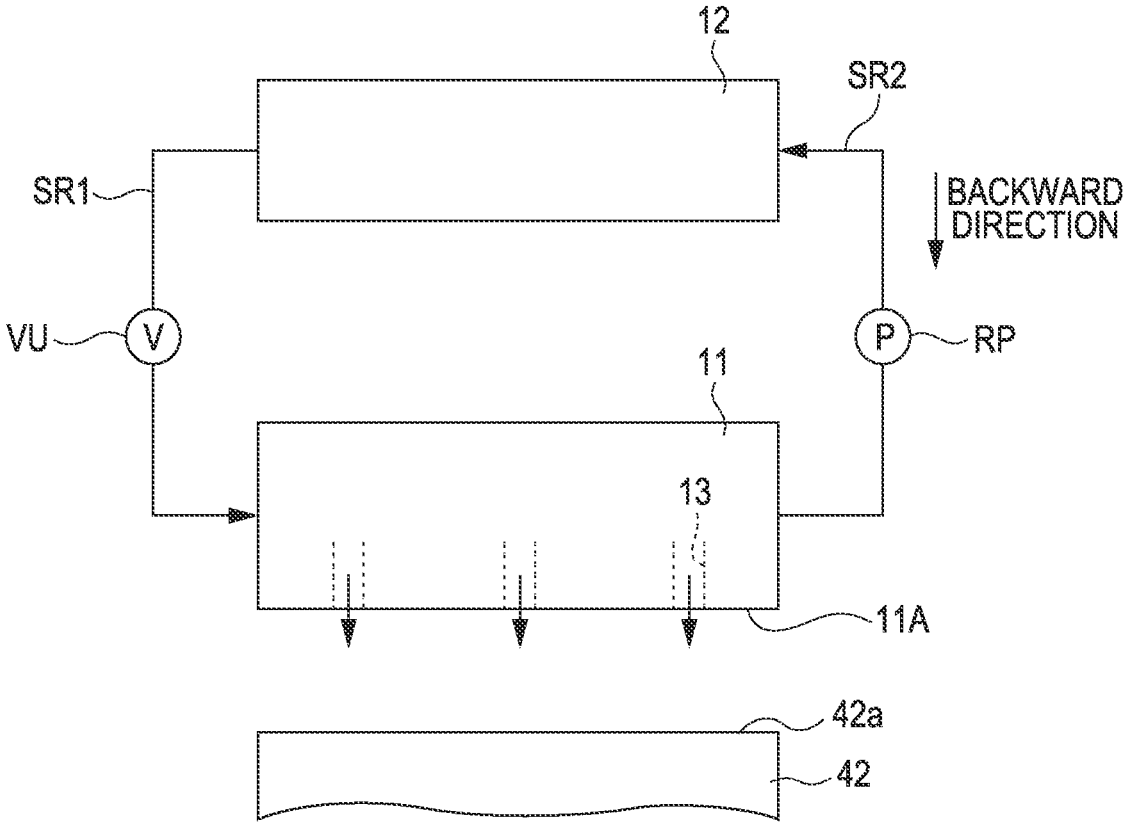
FIG. 9 is a view illustrating the operation of a printer apparatus.

In addition, as another aspect, the control device CONT may drive the supply pump RP so that the ink flows in the backward direction, as shown in FIG. 9, in the state where the ejection surface 11A of the ejection head 11 is not covered by the cap member 42. In this instance, since the first chamber R1 is pressurized and the flexible member F is bent in the direction of increasing the volume of the first chamber R1, the communication portion 52 is interrupted by the sealing portion V4. For this reason, in the state where the valve unit VU is in the closed state, the flow of the ink does not occur in the first supply tube SR1.

Further, the ink flowing into the ejection head 11 via the second supply tube SR2 is discharged outwardly to the ejection head 11 from the nozzle 13. Here, since the cap member 42 is retracted from the ejection path of the ejection head 11, the discharged ink is received by the absorbing member (not illustrated) or the like. The flushing (cleaning) operation can be performed by the ink supplied from the second supply tube SR2 side.

When the printing is carried out by using the ejection head 11, there is a case where alien substances are adhered to the nozzles 13 or the ink with increased viscosity is adhered to the nozzles 13. In this instance, at least one of the nozzles 13 provided in the ejection head 11 is clogged, thereby leading to a defective ejection state. The operation of supplying the sink, as shown in FIG. 9, can be performed for the purpose of addressing the above-described defective ejection state of the nozzles 13. Since the nozzles 13 with the defective ejection state can be cleaned through the ink supply operation, a suction mechanism for the cap member 42 is not necessary. Of course, the operation of supplying the ink may be performed for other purposes or in other cases.

As described above, according to this embodiment, since the printer apparatus includes the first supply tube SR1 for supplying the ink from the ink supply unit 12 to the ejection head 11, and the second supply tube SR2 which is provided separately from the first supply tube SR1, and communicates with the ejection head 11 and the ink supply unit 12, in which the ink is supplied in the forward direction by the supply pump RP provided in the second supply tube SR2 in the state where the cap member 42 comes into close contact with the ejection head 11, the ink is supplied in the state where the nozzles 13 are sealed. For this reason, it is possible to prevent inflow of the air from the nozzles at an interval of the ink supply. In addition, it is possible to prevent the ink from leaking from the nozzles.

It should be noted that the technical scope of the invention is not limited to the above-described embodiment, and proper modifications can be undergone within the scope without deviating from the aspects of the invention.

Figure 10A:
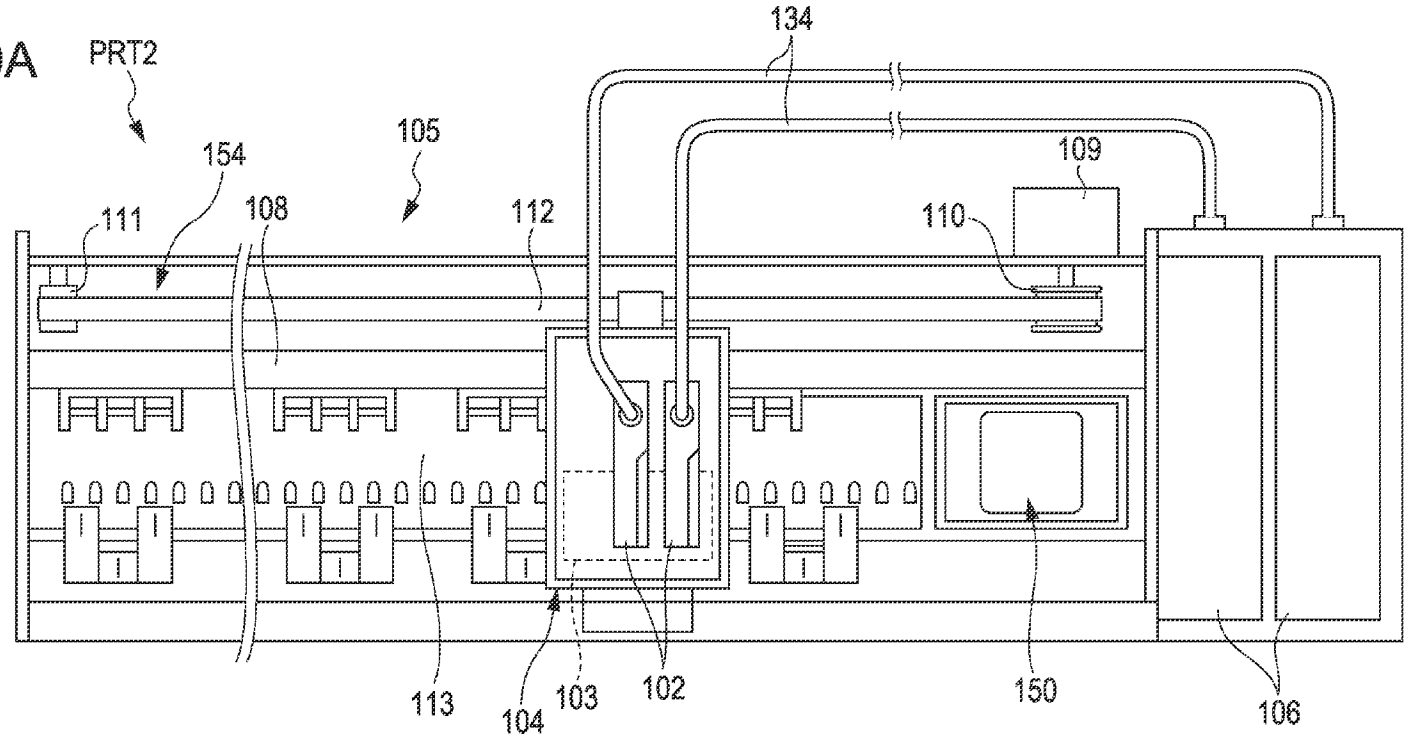
FIGS. 10A and 10B are perspective views schematically illustrating the configuration of a printer apparatus according to another embodiment of the invention.

For example, in the above-described embodiment, a configuration is described in which the invention is applied to the printer employing the line type head. However, the invention is not limited thereto, and may be applied to the printer apparatus PRT2 employing a serial type head, as shown in FIG. 10A.

In this instance, the configuration of the printer apparatus PRT2 will be described in brief. The printer apparatus PRT2 includes a printer body 105, and a carriage 104 on which a sub tank 102 and an ejection head 103 are mounted. The printer body 105 is provided with a carriage moving mechanism 154 for reciprocating the carriage 104, a capping device 150 for use in the cleaning operation or the like which suctions the ink with increased viscosity from each nozzle of the ejection head 103, and an ink cartridge 106 for storing the ink which is supplied to the ejection head 103 via an ink supply tube 134. The printer body 105 is provided with a sheet transport mechanism (not illustrated) for transporting a printing sheet. The sheet transport mechanism includes a sheet transport motor (not illustrated) or a sheet transport roller (not illustrated) which is rotated by the sheet transport motor, and is adapted to sequentially feed the printing sheets onto a platen 113 in connection with recording (printing) operation.

The carriage moving mechanism 154 includes a guide shaft 108 installed in a width direction of the printer body 105, a motor 109, a driving pulley 110 which is connected to a rotation shaft of the motor 109 and is rotated by the motor 109, an idle pulley 111 installed opposite to the driving pulley 110 in the width direction of the printer body 105, and a timing belt 112 suspended between the driving pulley 110 and the idle pulley 111 and is connected to the carriage 104. The carriage moving mechanism 154 drives the motor 109, so that the carriage 104 reciprocates along the guide shaft 108 in a main scanning direction.

The capping device 150 is placed at a home position in the printer body 105. The home position is an end area more outside than a printing region in the moving region of the carriage 104, and is set to a place in which the carriage 104 is positioned in a case where a power source is turned off or the recording is not performed for a long time. The printer apparatus PRT2 includes the configuration as described above.

Figure 10B:
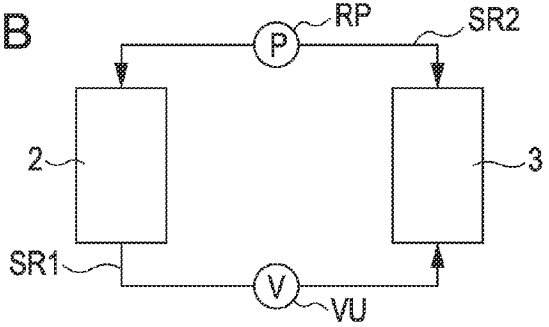

In addition, although the configuration in which the ejection head 11 is directly connected to the ink supply unit 12 is exemplified in this embodiment, the invention is not limited thereto. As shown in FIGS. 10A and 10B, a configuration may be provided, in which the ink cartridge (main tank) 106 and the sub tank 102 are provided as a tank for storing the ink, and the ink is circulated between the sub tank 102 and the ejection head 103 respective. In this instance, the invention can be applied by installing the first supply tube SR1 and the second supply tube SR2 as a flow passage for circulating the ink, placing the valve unit VU in the first supply tube SR1, and placing the supply pump RP in the second supply tube SR2.

In the above description, the ink jet printer and ink cartridge are employed, but a liquid ejecting apparatus for ejecting or discharging a liquid other than ink, and a liquid container for receiving the liquid may be employed. It may be applied to various liquid ejecting apparatuses including a liquid ejection head for discharging a minute number of liquid droplets. In this instance, the expression "liquid droplets" means the liquid ejected from the liquid ejecting apparatus, and includes a liquid having a particle shape, a tear shape, or a linear shape. Further, here, the liquid may be a material which can be ejected from the liquid ejecting apparatus.

For example, a liquid-state material may be used, and includes a liquid-state material such as sol or gel water having a high or low viscosity, a liquid-state material such as an inorganic solvent, an organic solvent, a liquid, a liquid-state resin, or liquid-state metal (metallic melt), and a material in which particles of a functional material having a solid material such as pigment or metal particles is dissolved, dispersed, or mixed with solvent in addition to a liquid, as one state of a substance. In addition, ink described in the embodiments may be exemplified as a typical example of the liquid, liquid crystal and the like. Here, the ink indicates general water-based ink, oil-based ink, gel ink, or hot-melt ink which contains various liquid compositions.

As a detailed example of the liquid ejecting apparatus, for example, a liquid crystal display, an EL (electro-luminance) display, a plane-emission display, a liquid ejecting apparatus for ejecting a liquid containing dispersed or melted materials such as an electrode material or a color material used to manufacture a color filter, a liquid ejecting apparatus for ejecting a biological organic material used to manufacture a biochip, a liquid ejecting apparatus for ejecting a liquid as a sample used as a precision pipette, a printing apparatus, or a micro dispenser may be used.

In addition, a liquid ejecting apparatus for ejecting lubricant from a pinpoint to a precision machine such as a watch or a camera, a liquid ejecting apparatus for ejecting a transparent resin liquid such as a UV-curing resin onto a substrate in order to form a minute hemispherical lens used for an optical transmission element or the like, or a liquid ejecting apparatus for ejecting an etching liquid such as an acid liquid or an alkali liquid in order to perform etching on a substrate or the like may be adopted. The invention may be applied to at least one kind of the above-described ejection apparatuses and the liquid container.

What is claimed is:

1. A liquid ejecting apparatus comprising:

a liquid ejection head that ejects a liquid via nozzles;

a first passage that communicates with the liquid ejection head, the first passage being configured to supply the liquid to the liquid ejection head;

a second passage that communicates with the first passage in the liquid ejection head, the second passage forming, in cooperation with the first passage, a circulation passage; and a liquid driving unit provided in the circulation passage, the liquid driving unit being configured to move the liquid in the circulation passage when driven;

wherein the liquid is moved, by the driven liquid driving unit, at a first flow rate that maintains a meniscus of the liquid inside the nozzles after the liquid is moved at a second flow rate that is faster than the first flow rate.

2. The liquid ejecting apparatus according to claim 1, wherein the liquid is moved in a direction in the circulation passage at the first flow rate and in the direction at the second flow rate.

3. The liquid ejecting apparatus according to claim 1, wherein the liquid is moved at the second flow rate, which is capable of breaking the meniscus of the liquid inside the nozzles.

4. The liquid ejecting apparatus according to claim 1, further comprising:

a cap configured to cover an area that includes the nozzles of the liquid ejection head;

wherein the liquid is moved at the second flow rate in a state in which the liquid ejection head is covered by the cap.

5. The liquid ejecting apparatus according to claim 1, further comprising:

a flexible member that constitutes part of an inner wall of the circulation passage, the flexible member deforming in accordance with a change of liquid pressure in the circulation passage.

6. The liquid ejecting apparatus according to claim 1, further comprising:

a valve provided in the first passage to allow and restrict flow of the liquid.

7. The liquid ejecting apparatus according to claim 6, wherein the liquid is moved at the first flow rate and the second flow rate in a state in which the valve allows the flow of the liquid.

8. The liquid ejecting apparatus according to claim 6, wherein the valve allows the flow of the liquid in the first passage to the liquid ejection head when pressure in the first passage between the valve and the liquid ejection head decreases and reaches a predetermined pressure higher than a first pressure at which the liquid is moved at the first flow rate.

9. The liquid ejecting apparatus according to claim 1, further comprising:

a flexible member that constitutes part of an inner wall of the circulation passage, the flexible member deforming in accordance with a change of liquid pressure in the circulation passage; and a valve provided in the first passage to allow and restrict flow of the liquid in accordance with deformation of the flexible member.

* * * * *